US005282553A

United States Patent [19]

Ibled

[11] Patent Number: 5,282,553

[45] Date of Patent: Feb. 1, 1994

[54] SHOE HOLDER

[75] Inventor: Stéphane Ibled, Bondues, France

[73] Assignee: S.A.R.L. Industrie Distribution Service, France

[21] Appl. No.: 884,598

[22] Filed: May 15, 1992

[30] Foreign Application Priority Data

May 17, 1991 [FR] France ..... 91 06348

[51] Int. Cl.[5] ..... A47G 25/14

[52] U.S. Cl. ..... 223/85; 206/292

[58] Field of Search ..... 223/85, DIG. 2; 24/712.7, 712.1, 712; 206/292, 293, 294, 296

[56] References Cited

U.S. PATENT DOCUMENTS

| | | | |
|---|---|---|---|
| D. 209,799 | 1/1968 | Stubbs | 223/85 X |
| 3,000,067 | 9/1961 | Hanflig | 24/87 |
| 4,023,762 | 5/1977 | Batts et al. | 223/85 |
| 4,221,298 | 9/1980 | Wright et al. | 223/85 X |
| 4,542,838 | 9/1985 | Perez-Tubens et al. | 223/85 X |
| 4,967,913 | 11/1990 | Bayer | 211/38 |

FOREIGN PATENT DOCUMENTS

| | | | |
|---|---|---|---|
| 1471666 | 1/1967 | France | 206/296 |
| 9010407 | 9/1990 | PCT Int'l Appl. | A47F 7/08 |
| 2103081 | 2/1993 | United Kingdom | A47F 7/08 |

*Primary Examiner*—Clifford D. Crowder
*Assistant Examiner*—Bibhu Mohanty
*Attorney, Agent, or Firm*—Ladas & Parry

[57] ABSTRACT

A shoe holder is disclosed, adapted to serve as display means in stores and more especially supermarkets, hypermarkets or specialized stores, with a view to facilitating sale of this type of article. The shoe holder comprises a central rod terminated by a hook for suspension and two lateral support elements on which the shoes are fitted. According to the invention, the shoes being joined by a supple tie of the fine steel cable or polyamide thread type, the shoe holder comprises means for connecting, via said tie, the central rod to the assembly constituted by the shoes and the supple tie. These so-called connection means are constituted in particular by at least one piece fast or integral with the central rod and comprising an opening whose periphery is closed and through which the supple tie passes. The invention mainly concerns shoe manufacturers and retailers and manufacturers of accessories made by injected plastic moulding.

10 Claims, 3 Drawing Sheets

SHOE HOLDER

FIELD OF THE INVENTION

The present invention relates to a shoe holder intended to serve as display means in stores, more particularly in supermarkets, hypermarkets or specialized stores selling these articles. It concerns mainly shoe manufacturers and retailers and manufacturers of accessories of injected plastics material.

BACKGROUND OF THE INVENTION

In a supermarket, shoes are generally placed on shelves without being packaged and the customer chooses from the articles displayed. For current articles, they may even be selected directly from tubs where the goods are placed in bulk. This sales technique is not suitable for shoes since the customer must be able to examine the different styles offered for sale, then check that the style chosen is available in his/her size, find two matching shoes and, finally, try them on to make sure that they fit.

Due to the customers' lack of discipline, there is very rapidly disorder in the shelves and it is necessary to check, shoe by shoe, to find the sizes. To facilitate the search, it has become current to use a supple tie such as for example a fine steel cable or a polyamide thread to join the two shoes going together.

Furthermore, to facilitate storage of shoes, accessory manufacturers have developed shoe holders which enable the pair of shoes to be arranged by order of size on a bar fixed in the shelves. This type of shoe holder, described in particular in document GB-A-2 103 081, comprises a central rod terminated by a hook for suspension and two lateral support elements on which a pair of shoes may be fitted. The advantage is the saving of space since the shoes are disposed vertically; furthermore, the styles are largely displayed, which enhances the product in the eyes of the public and this helps the customer to make his/her choice.

Unfortunately, experience has shown that, when the customer has tried on a pair of shoes which does not suit him, he does not put it back on its shoe holder. Therefore, not only the shoes, but also the shoe holders are in disorder. Similarly, experience has shown that the shoe holders are abandoned in the aisles after the customer has taken the chosen shoes.

It is an object of the invention to propose a shoe holder which overcomes the drawbacks set forth hereinabove, in that it is fast with the pair of shoes that it supports, is difficult to disconnect therefrom, whilst allowing the shoes to be easily tried on.

SUMMARY OF THE INVENTION

This object is perfectly attained by the shoe holder according to the invention which is constituted, in known manner, by a central rod terminated by a hook for suspension, and by two lateral support elements on which the shoes are fitted, and which is characterized in that the shoes are joined by a supple tie and the shoe holder comprises means for connecting, via the supple tie, the central rod to the assembly constituted by the shoes and the supple tie.

The supple tie which is of the fine steel cable or polyamide thread type, is difficult to break. If it is question of a polyamide thread, it may be envisaged that the connection means consist of a heatwelding spot applied to the supple tie and to the central rod. However, this type of embodiment is fairly fragile.

Consequently, in a first embodiment, the connection means are advantageously constituted by at least one piece fast or integral with the central rod, and comprising an opening whose periphery is closed and through which passes the supple tie. The dimensions of the opening may be identical to the section of the supple tie, in which case the latter is fixed with respect to the shoe holder. However, in order to make it easier to try the shoes on, the dimensions of the opening are generally larger than the section of the supple tie which may thus slide.

In the majority of cases, the dimensions of this opening does not allow passage of a shoe. Consequently, in the first embodiment, the periphery of the opening being closed, the passage of the supple tie through the opening is possible only if at least one of the ends of said tie is not yet fixed to a shoe. This means that the operation consisting in matching the shoes by means of the supple tie is effected at the same time as the operation of connection with the shoe holder.

For reasons of economy and versatility of use, it is important that the two operations mentioned be carried out consecutively; matching is for example firstly effected at the place of production of the shoes and connection with the shoe holder is then effected at the place of distribution. For this reason, the embodiments which are described at the present time and which avoid the servitude mentioned above are preferred.

In an embodiment which is an improvement of the first embodiment mentioned above, the piece fast or integral with the central rod is a supple fastening, particularly made of plastics material, of which one end is fixed to the central rod and comprising means for locking the other free end so as to form a closed loop. This closed loop defines the opening for the passage of the supple tie.

In a second embodiment, the connection means are constituted by at least one connection piece, fast or integral with the central rod and comprising an opening provided with a notch in which the supple tie is introduced during its placing through the opening, and by at least one closure piece, juxtaposed with respect to the connection piece at the level of the notch, so as to oppose exit via the notch of the supple tie traversing the opening, without opposing the introduction of said supple tie in said notch.

In a first variant embodiment, the connection and closure pieces are attached, the notch of the connection piece thus being completely closed. In that case, at least one of the two pieces is sufficiently flexible to allow introduction via the notch of the supple tie in the opening of the connection piece.

According to a second variant embodiment, the closure piece also comprises an opening and a notch and is juxtaposed with respect to the first piece, with the result that the two openings partially face each other, whilst the two notches are offset with respect to each other.

If the supple tie tends to leave one of the two pieces via the notch, the other piece forms an obstacle as the notches are not in register. In this variant, if the closure and connection pieces are not flexible, they are juxtaposed at a short distance, of the order of the section of the supple tie. The word "section" is used interchangeably with the word "cross-section".

The two variants mentioned above may advantageously be combined.

Whatever the embodiment of the connection means, the latter are advantageously mounted to pivot with respect to the longitudinal axis of the central rod. This characteristic enables the connection means to be folded down along said rod, which leads to a saving in space.

In all the embodiments mentioned above, the shoe holder is preferably made in one piece by plastic injection moulding. This allows resistant shoe holders to be mass produced.

BRIEF DESCRIPTION OF THE DRAWINGS

The invention will be more readily understood on reading the following description with reference to the accompanying drawings, in which.

DETAILED DESCRIPTION OF THE DRAWINGS

Figure 2:
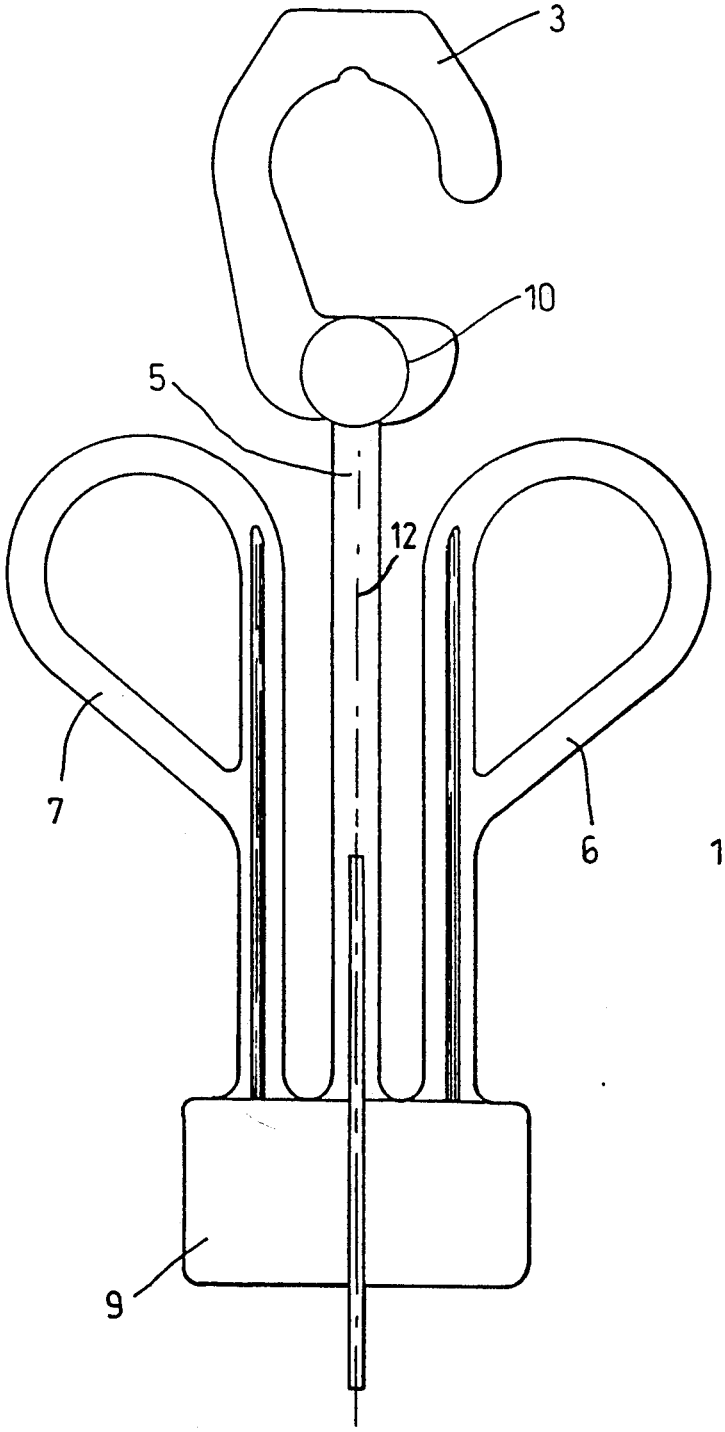
FIG. 2 is a front view of a particular embodiment of the shoe holder.
Figure 3:
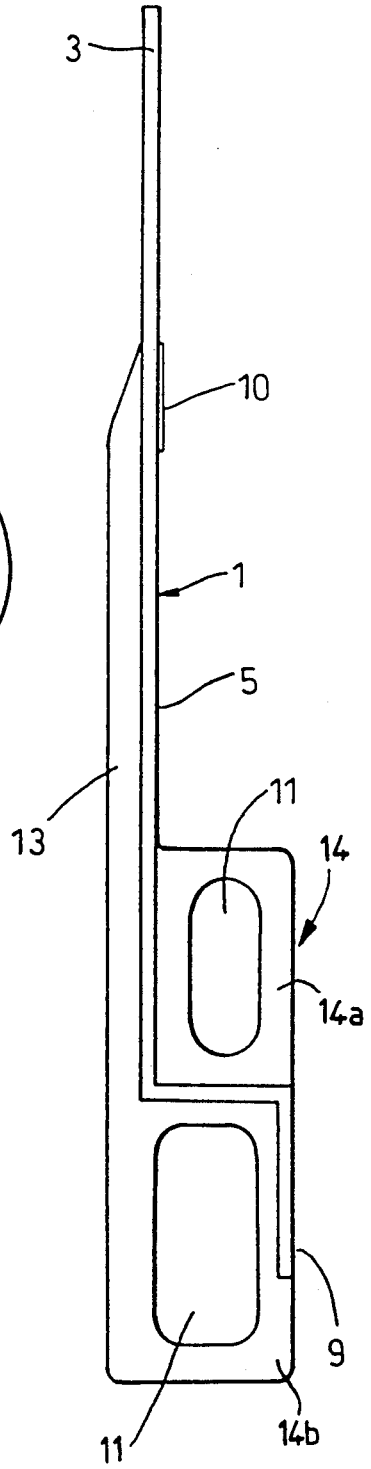
FIG. 3 is a side view of the shoe holder of FIG. 2.

Referring now to the drawings, FIGS. 2 and 3 show a particular shoe holder 1, seen respectively in front and side view.

It comprises a central rod 5 terminated in its upper part by the hook 3 for suspension and two lateral support elements 6 and 7 on which the shoes 2 are fitted. The shoes 2 are joined by a supple tie 8 which may for example be in the form of a fine metal cable or a polyamide thread. The purpose of this supple tie is to join two matching shoes and to prevent them from being separated.

The shoe holder 1 also comprises connection means 14 constituted by two pieces 14*a*, 14*b* integral perpendicularly to the central rod 5 and each comprising an opening 11 whose periphery is closed. These two pieces are substantially rectangular, and their larger side is parallel to the longitudinal axis 12 of the central rod 5, piece 14*a* being located above piece 14*b*. Each opening 11 is capable of being traversed by a supple tie 8; the choice of one or the other of the two openings 11 for passage of the tie depends on the position of the supple tie with respect to said openings, when the shoes that they connect are fitted on the support elements 6, 7.

Figure 1:
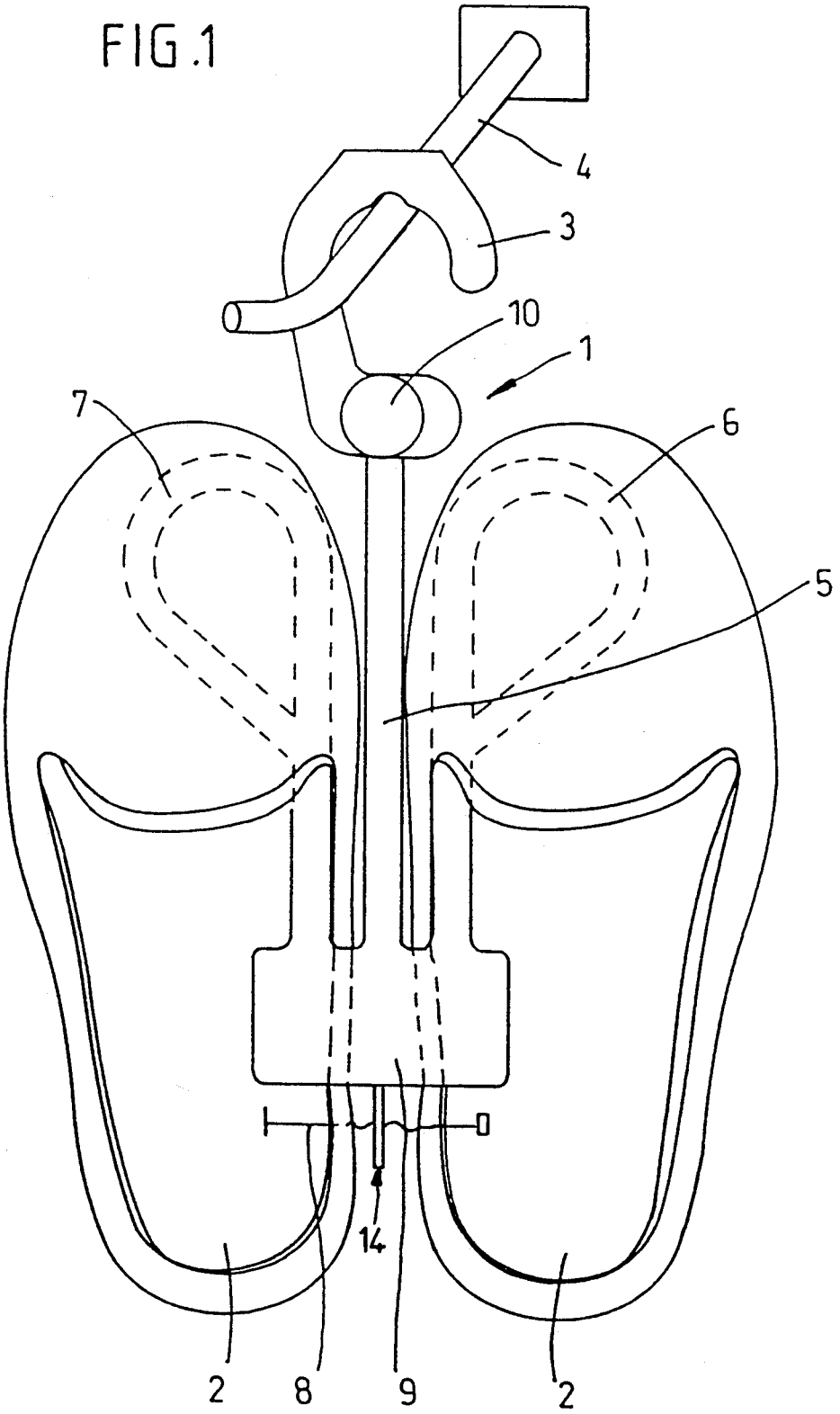
FIG. 1 shows a shoe holder according to the invention, serving as display means.

The operation for making an assembly as shown in FIG. 1, i.e. constituted on the one hand by the shoes 2 joined by a supple tie 8, and on the other hand, by the shoe holder 1, is as follows: One end of the supple tie is fixed to a first shoe 2. The latter may then be fitted on the support element 6. The free end of the supple tie is then passed through the closest opening 11. Then the free end is fixed to the second shoe, which may then be fitted on the other support element 7.

Openings 11 do not allow passage of a shoe. Thus, once the above-mentioned operation is terminated, the only way of separating the assembly constituted by the two shoes 2 joined by the supple tie 8 and the shoe holder 1, consists in cutting the supple tie. In this way, when a customer has tried on a pair of shoes which suits him, he takes the pair of shoes, together with the shoe holder, to the cash point, the shoe holder therefore not remaining on the shelves. Moreover, as it is easy and quick to hang the shoe holder up, the customer will tend to replace the shoe holder on the bar 4 after having tried on shoes which do not suit.

As the shoe holder 1 is difficult to separate from the shoes 2 which it supports, the size and price of the shoes can advantageously be directly marked on the shoe holder, without it being necessary to label the shoes. To that end, the shoe holder is equipped with a label support 9 adapted to receive indications on price, code bar or other characteristics, and with a location 10 where the size of the shoes can be marked.

The dimensions of openings 11 are clearly greater than the section of the supple tie 8, which may thus advantageously slide, this facilitating handling of the shoes when they are being tried on.

The shoe holder 1 is made in one piece by plastic injection moulding, this technique being known to the man skilled in the art. The central rod being made of plastic material, it is, in addition, preferably rigidified by the presence of a rear rib 13 as illustrated in FIG. 3.

Figure 4:
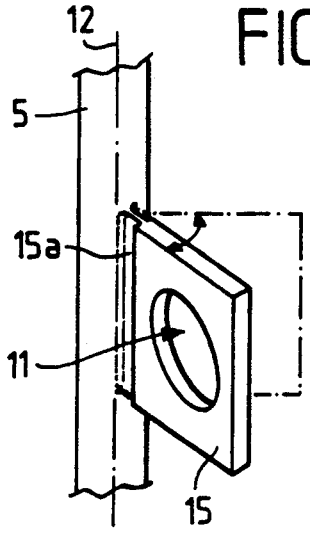
FIG. 4 shows a particular embodiment of the pivoting connection means.

FIG. 4 shows a piece 15 which is another embodiment of piece 14*a*. It is characterized by a join 15*a* between the central rod and the corresponding larger side of piece 15, which acts as hinge. The piece 15 may pivot about the longitudinal axis 12 of the central rod. This particular arrangement makes it possible to save space, particularly when transporting the shoes 2 and the shoe holder 1, by folding piece 15 down against the central rod 5.

In the case of plastic injection moulding, the mould is dimensioned so that the side of piece 15 corresponding to join 15*a* has a small thickness compared with the thickness of the central rod 5 and of piece 15. The material used for the join 15*a* must have characteristics of flexibility whilst being resistant. The join 15*a* may for example be made of polypropylene.

Figure 5:
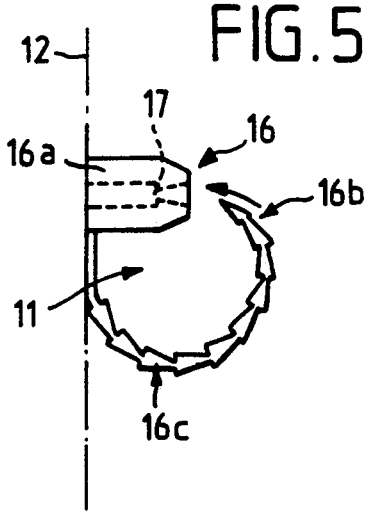
FIG. 5 is a side view of a supple fastening according to the invention.

FIG. 5 shows another particular embodiment of piece 14*a*. It consists of a supple fastening 16 comprising a hollow body 16*a* fixed to the central rod 5 and joined to a supple rod 16*c* provided with catches. The free end 16*b* of the supple rod 16*c* may pass through the opening 17 which is made in the hollow body 16*a*, and which extends in the central rod 5. This enables a closed loop defining an opening 11 to be made. The catches of the supple rod 16*c* cooperate with the particular profile of the opening 17 so that it is not possible to undo said loop once the free end 16*b* has passed through opening 17; the loop is then locked. This embodiment presents the advantage of allowing a connection of the assembly constituted by the shoes joined by a supple tie and by the shoe holder, once the shoes are matched in pairs by means of said supple tie. To that end, the loop defining the opening 11 is closed around the supple tie, the shoes joined by said tie being for example previously fitted on support elements 6, 7.

Figure 6:
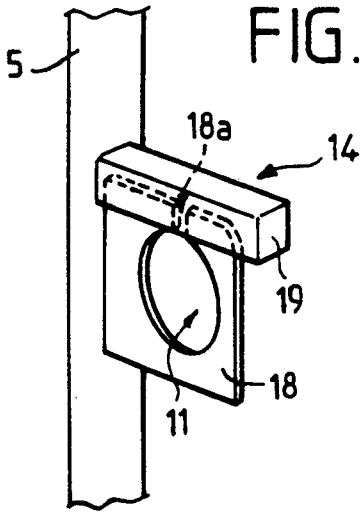
FIG. 6 shows connection means constituted by two pieces, of which one comprises an opening provided with a notch.

FIG. 6 shows another particular embodiment of the connection means 14. They are constituted by a first connection piece 18, differing from the piece 14a shown in FIG. 3 in that it further comprises in its upper part a notch 18a for the passage of the supple tie in opening 11. The upper part of the piece 18 penetrates in the inner recess of a second piece 19, called closure piece, having the shape of a rectangular parallelepiped and integral with the central rod 5 of the shoe holder 1. The space between the two pieces 18, 19 must be sufficient to allow passage of the supple tie, when it passes in the opening 11 via 18a. The function of piece 19 is to prevent the supple tie from exiting via the notch, particularly during handling of the shoe holder when trying on the shoes.

The notch 18a is preferably made in the upper part of the connection piece 18. In fact, if, during handling of the shoe holder, the shoes are no longer supported by the support elements 6, 7, the weight thereof will tend to pull the supple tie towards the lower part of piece 18.

Figure 7:
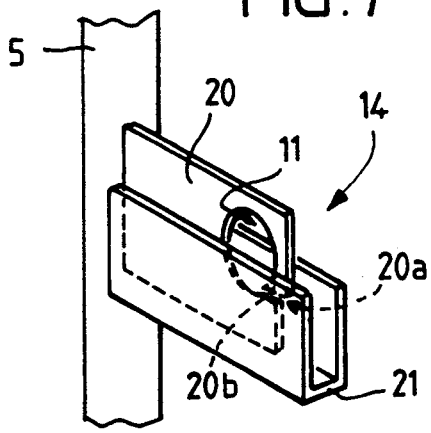
FIG. 7 shows a variant embodiment of the connection means of the type shown in FIG. 6.

However, connection means 14 shown in FIG. 7 may be imagined, constituted by two pieces 20 and 21, performing the same respective functions as the connection and closure pieces 18 and 19 of FIG. 6. Piece 20 differs from piece 18 in that its notch 20a is located in the lower part of the opening 11. This notch further presents a bevelled edge 20b which facilitates introduction of the supple tie in the opening 11 by guiding it.

Figure 8:
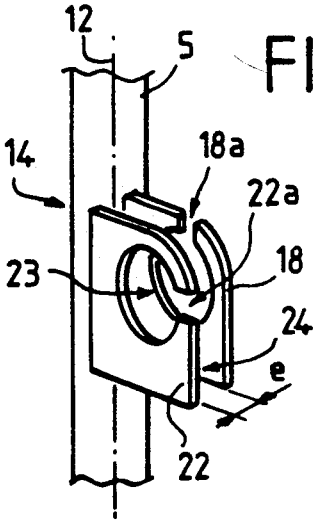
FIG. 8 shows connection means constituted by two pieces each comprising an opening provided with a notch.

FIG. 8 shows another particular embodiment of the connection means 14, in which the closure piece 19 of FIG. 3 is replaced by piece 22. This piece 22 is similar to piece 18 but differs therefrom by its notch 22a which is not located in the upper part. The two pieces are juxtaposed parallel to each other. The respective openings of pieces 18, 22 face one another, thus defining a passage 23 for the supple tie 8, and the notches 18a, 22a are not in register. When the two pieces are made of a rigid material and are not flexible, the space 24 separating them must have a width (e) greater than the section of the supple tie, thus allowing introduction of the supple tie in the passage 23 via the two notches 18a, 22a. If at least one of the two pieces is made of a flexible material, the two pieces may be attached. However, the flexible piece must be sufficiently so, to allow a sufficient spacing apart for the passage of the supple tie.

Once the supple tie is introduced in the passage 23, the function of piece 22 is to oppose exit of said tie via the notch 18a of piece 18 and vice versa. In the case of two non-flexible pieces, it is therefore preferable to choose a space 24 of minimum width (e), i.e. substantially equal to the section of the supple connection.

Figure 9:
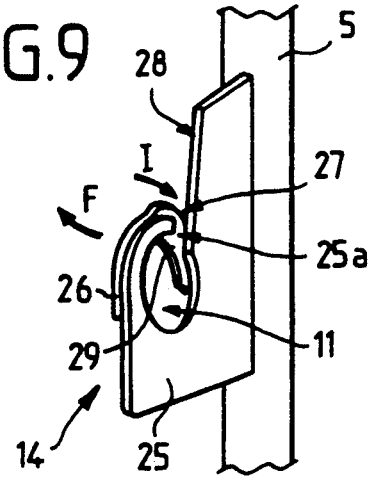
FIG. 9 shows connection means constituted by two pieces of which one, fast with the central rod, comprises an opening provided with a notch, the other piece being attached to the first piece.

FIG. 9 shows another particular embodiment of the connection means 14. They are constituted by two pieces 25, 26 attached fast with each other, piece 25 being fixed to the central rod 5 and the end 27 of piece 26 not being so. Piece 25, made of plastics material, comprises an opening 11 provided with a notch 25a which in the present case is located in its upper part; the inner wall 29 of the piece 26 is applied, at the level of the free end 27, against the wall 28 of the piece 25, thus completely closing the notch 25a.

The supple tie 8 is introduced in opening 11 via notch 25a by sliding the supple tie positioned transversely to the opening, along the edge of the free end 27 of piece 26 in the direction of arrow I shown schematically in FIG. 9; the edge of the end 27 has a rounded shape allowing guiding of the supple tie. Piece 25 being slightly flexible at the level of its notch 25a, during said introduction of the supple tie 8, the wall 29 moves away from the wall 28 under the action of said tie, so as to allow passage thereof. In order to introduce the supple tie in the opening 11 via the notch 25a, the walls 28 and 29 may also previously be slightly spaced apart by exerting a slight pressure in the direction of arrow F on the assembly constituted by pieces 25 and 26.

When the supple tie is introduced, the wall 29 resumes its initial position; walls 28, 29 are again

10 attached The supple tie 8 can therefore no longer leave the opening 11 via the notch 25a, which is closed by the end 27 of the piece 26.

The invention is not limited to the embodiments described hereinabove but covers all the variants thereof. Whatever the embodiment of the connection means 14, they may be mounted to pivot about the longitudinal axis 12 of the central rod 5; the shoe holder, including said connection means 14, may be made in one piece by plastic injection moulding. A shoe holder may also be envisaged, comprising a larger number of connection means, each of these connection means being able to be designed in accordance with a different particular embodiment.

What is claimed is:

1. A shoe holder and shoe combination intended to serve as display means in stores, comprising a central rod terminated by a hook at one end for suspension, and two lateral support elements on another end, a shoe mounted on each support element, wherein the shoes are connected by a supple tie, said shoe holder comprising means for connecting, via said tie, the central rod to an assembly constituted by the shoes and the supple tie, wherein the connection means are constituted by at least one connection piece integral with and extending transverse to the central rod and comprising an opening through which the supple tie passes.

2. The shoe holder of claim 1, wherein the connection means are constituted by at least one piece fast or integral with the central rod and comprising an opening whose periphery is closed and through which the supple tie passes.

3. The shoe holder of claim 2, wherein the connection piece is a supple fastening attachment of which one end is fixed to the central rod and which comprises means for locking the other free end, and the opening for passage of the supple tie is constituted by the loop formed by the supple fastening attachment after its free end is locked.

4. The shoe holder of claim 1, wherein the opening of the connection piece is provided with a notch in which the supple tie is introduced during the placing of said tie through the opening, and the connection means further comprise at least one closure piece juxtaposed with respect to the connection piece at the level of its notch so as to oppose exit through the notch of the supple tie traversing the opening.

5. The shoe holder of claim 4, wherein the closure piece also comprises an opening and a notch, and it is juxtaposed with respect to the connection piece so that the two openings partially face each other, whilst the two notches are offset with respect to each other.

6. Shoe holder according to claim 5, wherein the closure and connection piece are not flexible and are juxtaposed at a short distance.

7. The shoe holder of claim 4, wherein the connection and closure pieces are attached, and at least one of the two pieces is sufficiently flexible to allow introduction of the supple tie in the opening of the connection piece and, if necessary, in the opening of the closure piece.

8. The shoe holder of claim 1, wherein the connection means are mounted to pivot with respect to the longitudinal axis of the central rod.

9. The shoe holder of claim 8, wherein the connection means comprise a flexible join of small thickness, acting as hinge.

10. The shoe holder of claim 1, wherein the holder is made in one piece by plastic injection molding.

* * * * *